US012228335B2

(12) United States Patent
Mak

(10) Patent No.: US 12,228,335 B2
(45) Date of Patent: Feb. 18, 2025

(54) CONFIGURATIONS AND METHODS FOR NGL RECOVERY FOR HIGH NITROGEN CONTENT FEED GASES

(71) Applicant: Fluor Technologies Corporation, Sugar Land, TX (US)

(72) Inventor: John Mak, Santa Ana, CA (US)

(73) Assignee: FLUOR TECHNOLOGIES CORPORATION, Sugarland, TX (US)

( * ) Notice: Subject to any disclaimer, the term of this patent is extended or adjusted under 35 U.S.C. 154(b) by 1514 days.

(21) Appl. No.: 16/260,288

(22) Filed: Jan. 29, 2019

(65) Prior Publication Data

US 2019/0154333 A1 May 23, 2019

Related U.S. Application Data

(63) Continuation of application No. 14/033,096, filed on Sep. 20, 2013, now abandoned.

(60) Provisional application No. 61/703,654, filed on Sep. 20, 2012.

(51) Int. Cl.
*F25J 3/02* (2006.01)

(52) U.S. Cl.
CPC ..... *F25J 3/0228* (2013.01); *F25J 3/0209* (2013.01); *F25J 3/0233* (2013.01); *F25J 3/0238* (2013.01); *F25J 3/0242* (2013.01); *F25J 2200/04* (2013.01); *F25J 2200/70* (2013.01); *F25J 2200/74* (2013.01); *F25J 2200/76* (2013.01); *F25J 2200/78* (2013.01); *F25J 2205/04* (2013.01); *F25J 2210/06* (2013.01); *F25J 2240/02* (2013.01); *F25J 2270/90* (2013.01); *F25J 2280/02* (2013.01)

(58) Field of Classification Search
CPC ..... F25J 3/0233; F25J 3/0238; F25J 3/0242; F25J 3/0209
USPC ..... 62/630
See application file for complete search history.

(56) References Cited

U.S. PATENT DOCUMENTS

| | | | |
|---|---|---|---|
| 2,603,310 | A | 7/1952 | Gilmore et al. |
| 2,771,149 | A | 11/1956 | Miller et al. |
| 3,320,754 | A | 5/1967 | Tucker et al. |
| 3,421,610 | A | 1/1969 | Marshall et al. |
| 3,421,984 | A | 1/1969 | Jensen et al. |
| 3,793,157 | A | 2/1974 | Hobbs et al. |
| 4,004,430 | A | 1/1977 | Solomon et al. |
| 4,061,481 | A | 12/1977 | Campbell et al. |
| 4,102,659 | A | 7/1978 | Martin |

(Continued)

FOREIGN PATENT DOCUMENTS

| | | |
|---|---|---|
| AR | 103703 | 5/2017 |
| AR | 115412 A1 | 1/2021 |

(Continued)

OTHER PUBLICATIONS

Examination Report dated Jul. 9, 2020, European Patent Application No. 167497733.9 filed Feb. 9, 2016.

(Continued)

*Primary Examiner* — John F Pettitt, III
(74) *Attorney, Agent, or Firm* — Ryan D. Jenlink; Conley Rose, P.C.

(57) ABSTRACT

A low cost and efficient design is used to convert a propane recovery process based on low nitrogen content feed gas to an ethane recovery process based on a high nitrogen feed gas while achieving over 95 mole % ethane recovery while maintaining a 99% propane recovery, and achieved without additional equipment.

6 Claims, 4 Drawing Sheets

(56) References Cited

U.S. PATENT DOCUMENTS 4,157,904 A 6/1979 Campbell et al.
4,164,452 A 8/1979 Funk et al.
4,203,742 A 5/1980 Agnihotri
4,278,457 A 7/1981 Campbell et al.
4,453,958 A 6/1984 Gulsby et al.
4,474,591 A 10/1984 Arand et al.
4,496,380 A 1/1985 Harryman
4,507,133 A 3/1985 Khan et al.
4,509,967 A 4/1985 Sweet
4,519,824 A 5/1985 Huebel
4,617,039 A 10/1986 Buck
4,657,571 A 4/1987 Gazzi
4,676,812 A 6/1987 Kummann
4,695,349 A 9/1987 Becker et al.
4,854,955 A 8/1989 Campbell et al.
4,895,584 A 1/1990 Buck et al.
5,220,797 A 6/1993 Krishnamurthy et al.
5,291,736 A 3/1994 Paradowski
5,462,583 A 10/1995 Wood et al.
5,555,748 A 9/1996 Campbell et al.
5,657,643 A 8/1997 Price
5,669,238 A 9/1997 Devers
5,685,170 A 11/1997 Sorensen
5,687,584 A 11/1997 Mehra
5,746,066 A 5/1998 Manley
5,771,712 A 6/1998 Campbell et al.
5,881,569 A 3/1999 Campbell et al.
5,890,377 A 4/1999 Foglietta
5,890,378 A 4/1999 Rambo et al.
5,953,935 A 9/1999 Sorensen
5,983,664 A 11/1999 Campbell et al.
5,992,175 A 11/1999 Yao et al.
6,006,546 A 12/1999 Espie
6,112,549 A 9/2000 Yao et al.
6,116,050 A 9/2000 Yao et al.
6,116,051 A 9/2000 Agrawal et al.
6,125,653 A 10/2000 Shu et al.
6,182,469 B1 2/2001 Campbell et al.
6,244,070 B1 6/2001 Lee et al.
6,308,532 B1 10/2001 Hopewell
6,311,516 B1 11/2001 Key et al.
6,336,344 B1 1/2002 OBrien
6,354,105 B1 3/2002 Lee et al.
6,363,744 B2 4/2002 Finn et al.
6,368,385 B1 4/2002 Paradowski
6,401,486 B1 6/2002 Lee et al.
6,405,561 B1 6/2002 Lee et al.
6,453,698 B2 9/2002 Jain et al.
6,516,631 B1 2/2003 Trebble
6,601,406 B1 8/2003 Deng et al.
6,658,893 B1 12/2003 Mealey
6,712,880 B2 3/2004 Foglietta et al.
6,755,965 B2 6/2004 Pironti et al.
6,823,692 B1 11/2004 Patel et al.
6,837,070 B2 1/2005 Mak
6,915,662 B2 7/2005 Wilkinson et al.
7,051,552 B2 5/2006 Mak
7,051,553 B2 5/2006 Mak et al.
7,069,744 B2 7/2006 Patel et al.
7,073,350 B2 7/2006 Mak
7,107,788 B2 9/2006 Patel et al.
7,159,417 B2 1/2007 Foglietta et al.
7,192,468 B2 3/2007 Mak et al.
7,216,507 B2 5/2007 Cuellar et al.
7,219,513 B1 5/2007 Mostafa
7,377,127 B2 5/2008 Mak
7,424,808 B2 9/2008 Mak
7,437,891 B2 10/2008 Reyneke et al.
7,574,856 B2 8/2009 Mak
7,597,746 B2 10/2009 Mak et al.
7,600,396 B2 10/2009 Mak
7,635,408 B2 12/2009 Mak et al.
7,637,987 B2 12/2009 Mak
7,674,444 B2 3/2010 Mak
7,713,497 B2 5/2010 Mak
7,856,847 B2 12/2010 Patel et al.
7,856,848 B2 12/2010 Lu
8,110,023 B2 2/2012 Mak et al.
8,117,852 B2 2/2012 Mak
8,142,648 B2 3/2012 Mak
8,147,787 B2 4/2012 Mak et al.
8,192,588 B2 6/2012 Mak
8,196,413 B2 6/2012 Mak
8,209,996 B2 7/2012 Mak
8,316,665 B2 11/2012 Mak
8,377,403 B2 2/2013 Mak
8,398,748 B2 3/2013 Mak
8,434,325 B2 5/2013 Martinez et al.
8,480,982 B2 7/2013 Mak et al.
8,505,312 B2 8/2013 Mak et al.
8,528,361 B2 9/2013 Nanda et al.
8,567,213 B2 10/2013 Mak
8,635,885 B2 1/2014 Mak
8,661,820 B2 3/2014 Mak
8,677,780 B2 3/2014 Mak
8,695,376 B2 4/2014 Mak
8,696,798 B2 4/2014 Mak
8,840,707 B2 9/2014 Mak
8,845,788 B2 9/2014 Mak
8,850,849 B2 10/2014 Martinez et al.
8,876,951 B2 11/2014 Mak
8,893,515 B2 11/2014 Mak
8,910,495 B2 12/2014 Mak
8,919,148 B2 12/2014 Wilkinson et al.
8,950,196 B2 2/2015 Mak
9,103,585 B2 8/2015 Mak
9,114,351 B2 8/2015 Mak
9,132,379 B2 9/2015 Mak
9,248,398 B2 2/2016 Mak
9,423,175 B2 8/2016 Mak
9,557,103 B2 1/2017 Mak
9,631,864 B2 4/2017 Chen et al.
10,006,701 B2 6/2018 Mak
10,077,938 B2 9/2018 Mak
10,330,382 B2 6/2019 Mak et al.
10,451,344 B2 10/2019 Mak
10,704,832 B2 7/2020 Mak
10,760,851 B2 9/2020 Thiebault et al.
11,112,175 B2 9/2021 Mak
11,365,933 B2 6/2022 Mak et al.
11,725,879 B2 8/2023 Mak
2002/0042550 A1 4/2002 Pironti et al.
2002/0157538 A1 10/2002 Foglietta et al.
2003/0005722 A1 1/2003 Wilkinson et al.
2003/0089126 A1 5/2003 Stringer et al.
2004/0079107 A1 4/2004 Wilkinson et al.
2004/0148964 A1 8/2004 Patel et al.
2004/0159122 A1 8/2004 Patel et al.
2004/0172967 A1 9/2004 Patel et al.
2004/0206112 A1 10/2004 Mak
2004/0237580 A1 12/2004 Mak
2004/0250569 A1 12/2004 Mak
2004/0261452 A1 12/2004 Mak et al.
2005/0047995 A1 3/2005 Wylie
2005/0201410 A1 9/2005 Sekine
2005/0218041 A1 10/2005 Yoshida et al.
2005/0247078 A1 11/2005 Wilkinson et al.
2005/0255012 A1 11/2005 Mak
2005/0268649 A1 12/2005 Wilkinson et al.
2006/0000234 A1 1/2006 Cuellar et al.
2006/0021379 A1 2/2006 Ronczy
2006/0032269 A1 2/2006 Cuellar et al.
2006/0260355 A1 11/2006 Roberts et al.
2006/0277943 A1 12/2006 Yokohata et al.
2006/0283207 A1 12/2006 Pitman et al.
2007/0157663 A1 7/2007 Mak et al.
2007/0240450 A1 10/2007 Mak
2008/0016909 A1 1/2008 Lu
2008/0190136 A1 8/2008 Pitman
2008/0271480 A1 11/2008 Mak
2009/0100862 A1 4/2009 Wilkinson et al.
2009/0113931 A1 5/2009 Patel et al.
2009/0277217 A1 11/2009 Ransbarger et al.
2010/0000255 A1 1/2010 Mak

(56) References Cited

U.S. PATENT DOCUMENTS

| | | | |
|---|---|---|---|
| 2010/0011809 | A1 | 1/2010 | Mak |
| 2010/0011810 | A1 | 1/2010 | Mak et al. |
| 2010/0043488 | A1 | 2/2010 | Mak et al. |
| 2010/0126187 | A1 | 5/2010 | Mak |
| 2010/0206003 | A1 | 8/2010 | Mak |
| 2010/0275647 | A1 | 11/2010 | Johnke et al. |
| 2010/0287984 | A1 | 11/2010 | Johnke et al. |
| 2011/0067442 | A1 | 3/2011 | Martinez et al. |
| 2011/0067443 | A1 | 3/2011 | Martinez et al. |
| 2011/0174017 | A1 | 7/2011 | Victory et al. |
| 2011/0226014 | A1 | 9/2011 | Johnke et al. |
| 2011/0265511 | A1 | 11/2011 | Fischer et al. |
| 2012/0000245 | A1 | 1/2012 | Currence et al. |
| 2012/0085127 | A1 | 4/2012 | Nanda et al. |
| 2012/0096896 | A1 | 4/2012 | Patel et al. |
| 2012/0137726 | A1 | 6/2012 | Currence et al. |
| 2013/0061632 | A1 | 3/2013 | Brostow et al. |
| 2013/0061633 | A1 | 3/2013 | Mak et al. |
| 2013/0186133 | A1 | 7/2013 | Ploeger et al. |
| 2013/0298602 | A1 | 11/2013 | Prim |
| 2014/0013797 | A1 | 1/2014 | Butts |
| 2014/0026615 | A1 | 1/2014 | Mak |
| 2014/0060114 | A1 | 3/2014 | Mak |
| 2014/0075987 | A1 | 3/2014 | Mak |
| 2014/0182331 | A1 | 7/2014 | Burmberger et al. |
| 2014/0260420 | A1 | 9/2014 | Mak |
| 2014/0290307 | A1 | 10/2014 | Gahier et al. |
| 2014/0345319 | A1 | 11/2014 | Santos |
| 2015/0184931 | A1 | 7/2015 | Mak |
| 2015/0322350 | A1 | 11/2015 | Iyer et al. |
| 2016/0069610 | A1 | 3/2016 | Ascencion et al. |
| 2016/0231052 | A1 | 8/2016 | Mak |
| 2016/0327336 | A1 | 11/2016 | Kennedy et al. |
| 2017/0051970 | A1 | 2/2017 | Mak |
| 2017/0058708 | A1 | 3/2017 | Noureldin et al. |
| 2017/0336137 | A1 | 11/2017 | Mak et al. |
| 2018/0017319 | A1 | 1/2018 | Mak et al. |
| 2018/0058754 | A1 | 3/2018 | Lynch et al. |
| 2018/0066889 | A1 | 3/2018 | Gaskin et al. |
| 2018/0149425 | A1 | 5/2018 | Oneal et al. |
| 2018/0231305 | A1 | 8/2018 | Pierre, Jr. |
| 2018/0266760 | A1 | 9/2018 | Mak |
| 2018/0306498 | A1 | 10/2018 | Rovers et al. |
| 2018/0320960 | A1 | 11/2018 | Terrien et al. |
| 2018/0347899 | A1 | 12/2018 | Cuellar et al. |
| 2019/0011180 | A1 | 1/2019 | Mostafa |
| 2019/0086147 | A1 | 3/2019 | Brown, III et al. |
| 2019/0154333 | A1 | 5/2019 | Mak |
| 2019/0242645 | A1 | 8/2019 | Mak |
| 2019/0271503 | A1 | 9/2019 | Terrien et al. |
| 2020/0064064 | A1 | 2/2020 | Butts |
| 2020/0072546 | A1 | 3/2020 | Thom et al. |
| 2020/0141639 | A1 | 5/2020 | Mak |
| 2020/0191477 | A1 | 6/2020 | Mak |
| 2020/0199046 | A1 | 8/2020 | Simon et al. |
| 2020/0370824 | A1 | 11/2020 | Mak et al. |
| 2021/0095921 | A1 | 4/2021 | Mak et al. |
| 2021/0381760 | A1 | 12/2021 | Mak |
| 2023/0349633 | A1 | 11/2023 | Mak |

FOREIGN PATENT DOCUMENTS

| | | | |
|---|---|---|---|
| AR | 115412 | B1 | 5/2023 |
| AU | 2002303849 | A1 | 12/2003 |
| AU | 2008287322 | A1 | 2/2009 |
| AU | 2011349713 | A1 | 7/2013 |
| AU | 2016407529 | A1 | 11/2018 |
| CA | 2176430 | A1 | 4/1997 |
| CA | 2484085 | A1 | 12/2003 |
| CA | 2694149 | A1 | 2/2009 |
| CA | 3084911 | A1 | 12/2012 |
| CA | 2976071 | | 8/2017 |
| CA | 289132 | C | 9/2020 |
| CA | 2976071 | C | 10/2020 |
| CA | 3008229 | C | 1/2022 |
| CA | 3022085 | C | 5/2023 |
| CN | 101815915 | A | 8/2010 |
| CN | 113795461 | A | 12/2021 |
| DE | 60224585 | T2 | 4/2009 |
| EA | 201390957 | A1 | 12/2013 |
| EP | 0010939 | A1 | 5/1980 |
| EP | 1508010 | A1 | 2/2005 |
| EP | 2185878 | A1 | 5/2010 |
| EP | 2521761 | A1 | 11/2012 |
| EP | 2655992 | A1 | 10/2013 |
| EP | 3256550 | A1 | 12/2017 |
| EP | 3400278 | A1 | 11/2018 |
| EP | 3894047 | A1 | 10/2021 |
| GC | 0004114 | | 4/2016 |
| JP | 2007510124 | A | 4/2007 |
| MX | 391995 | | 5/2002 |
| MX | 2010001472 | A | 3/2010 |
| MX | 2013007136 | A | 8/2013 |
| MX | 411149 | | 3/2024 |
| WO | 99023428 | | 5/1999 |
| WO | 0188447 | A1 | 11/2001 |
| WO | 2002014763 | | 2/2002 |
| WO | 2002079706 | | 10/2002 |
| WO | 2003095913 | | 11/2003 |
| WO | 2003100334 | | 12/2003 |
| WO | 2004017002 | A1 | 2/2004 |
| WO | 2004065868 | A2 | 8/2004 |
| WO | 2004076946 | A2 | 9/2004 |
| WO | 2004080936 | A1 | 9/2004 |
| WO | 20044580 | A | 12/2004 |
| WO | 2005045338 | A1 | 5/2005 |
| WO | 2007001669 | A2 | 1/2007 |
| WO | 2007014069 | A2 | 2/2007 |
| WO | 2007014209 | A2 | 2/2007 |
| WO | 2008002592 | A2 | 1/2008 |
| WO | 2009023252 | A1 | 2/2009 |
| WO | 2011123278 | A1 | 10/2011 |
| WO | 2012087740 | A1 | 6/2012 |
| WO | 2012177749 | A2 | 12/2012 |
| WO | 2014047464 | A1 | 3/2014 |
| WO | 2014151908 | A1 | 9/2014 |
| WO | 2016130574 | A1 | 8/2016 |
| WO | 2017119913 | A1 | 7/2017 |
| WO | 2017200557 | A1 | 11/2017 |
| WO | 2018049128 | A1 | 3/2018 |
| WO | 2019078892 | A1 | 4/2019 |
| WO | 2019226156 | A1 | 11/2019 |
| WO | 20200123814 | A1 | 6/2020 |

OTHER PUBLICATIONS

Office Action dated Jun. 28, 2018, CA Application No. 2,839, 132, filed on Dec. 11, 2013.

Office Action dated Jun. 29, 2018, MX Application No. MX/A/2013/014864, filed on Dec. 13, 2013.

Notice of Allowance dated Oct. 18, 2018, MX Application No. MX/A/2013/014864, filed on Dec. 13, 2013.

Restriction Requirement dated Nov. 19, 2015, U.S. Appl. No. 14/033,096, filed Sep. 20, 2013.

Office Action dated Jun. 2, 2016, U.S. Appl. No. 14/033,096, filed Sep. 20, 2013.

Final Office Action dated Dec. 9, 2016, U.S. Appl. No. 14/033,096, filed Sep. 20, 2013.

Advisory Action dated Feb. 28, 2017, U.S. Appl. No. 14/033,096, filed Sep. 20, 2013.

Office Action dated May 11, 2017, U.S. Appl. No. 14/033,096, filed Sep. 20, 2013.

Final Office Action dated Nov. 15, 2017, U.S. Appl. No. 14/033,096, filed Sep. 20, 2013.

Advisory Action dated Feb. 6, 2018, U.S. Appl. No. 14/033,096, filed Sep. 20, 2013.

Office Action dated Mar. 26, 2018, U.S. Appl. No. 14/033,096, filed Sep. 20, 2013.

Final Office Action dated Oct. 17, 2018, U.S. Appl. No. 14/033,096, filed Sep. 20, 2013.

Office Action dated Nov. 25, 2015, U.S. Appl. No. 14/210,061, filed Mar. 14, 2014.

(56) References Cited

OTHER PUBLICATIONS

Notice of Allowance dated Mar. 26, 2016, U.S. Appl. No. 14/210,061, filed Mar. 14, 2014.
Office Action dated Sep. 26, 2017, U.S. Appl. No. 15/019,570, filed Feb. 6, 2016.
Notice of Allowance dated May 18, 2018, U.S. Appl. No. 15/019,570, filed Feb. 6, 2016.
Office Action dated Jul. 7, 2017, U.S. Appl. No. 15/158,143, filed May 16, 2016.
Final Office Action dated Nov. 1, 2017, U.S. Appl. No. 15/158,143, filed May 16, 2016.
Office Action dated Mar. 14, 2018, U.S. Appl. No. 15/158,143, filed May 16, 2016.
Final Office Action dated Jun. 29, 2018, U.S. Appl. No. 15/158,143, filed May 16, 2016.
Office Action dated Oct. 4, 2018, U.S. Appl. No. 15/158,143, filed May 16, 2016.
Foreign Communication from a Related Counterpart—International Search Report and Written Opinion, dated Aug. 24, 2016, PCT/US2016/013687 , filed on Jan. 15, 2016.
Foreign Communication from a Related Counterpart—International Preliminary Examination Report, dated Jul. 19, 2018, PCT/US2016/013687 , filed on Jan. 15, 2016.
International Application No. PCT/US02/16311, International Preliminary Examination Report, mailed Feb. 19, 2003, 6 pages.
Foreign Communication from a Related Counterpart—International Search Report and Written Opinion, dated Feb. 16, 2005, PCT/US2004/032788, filed on Oct. 5, 2004.
Foreign Communication from a Related Counterpart—International Preliminary Report on Patentability, dated Feb. 27, 2006, PCT/US2004/032788, filed on Oct. 5, 2004.
International Application No. PCT/US08/09736, Written Opinion of the International Searching Authority, mailed Nov. 3, 2008, 5 pages.
International Application No. PCT/US08/09736, International Preliminary Report on Patentability, mailed May 25, 2010, 6 pages.
Foreign Communication from a Related Counterpart—International Search Report and Written Opinion, dated Apr. 18, 2012, PCT/2011/065140, filed on Dec. 15, 2011.
Foreign Communication from a Related Counterpart—International Preliminary Report on Patentability, dated Jun. 25, 2013, PCT/2011/065140, filed on Dec. 15, 2011.
Foreign Communication from a Related Counterpart—International Search Report and Written Opinion, dated Jul. 21, 2013, PCT/US2012/043332, filed Jun. 20, 2012.
Foreign Communication from a Related Counterpart—International Preliminary Report on Patentability, dated Jan. 4, 2015, PCT/US2012/043332, filed Jun. 20, 2012.
Foreign Communication from a Related Counterpart—International Search Report and Written Opinion, dated Jan. 14, 2014, PCT/US2013/060971, filed Sep. 20, 2013.
Foreign Communication from a Related Counterpart—International Preliminary Report on Patentability, dated Jan. 7, 2015, PCT/US2013/060971, filed Sep. 20, 2013.
Foreign Communication from a Related Counterpart—International Search Report and Written Opinion, dated Jul. 1, 2016, PCT/US2016/017190, filed Feb. 6, 2016.
Foreign Communication from a Related Counterpart—International Preliminary Report on Patentability, dated Aug. 24, 2017, PCT/US2016/017190, filed Feb. 6, 2016.
Foreign Communication from a Related Counterpart—International Search Report and Written Opinion, dated Jul. 7, 2014, PCT/US2014/026655, filed on Mar. 14, 2014.
Foreign Communication from a Related Counterpart—International Preliminary Report on Patentability, dated Sep. 15, 2015, PCT/US2014/026655, filed on Mar. 14, 2014.
Foreign Communication from a Related Counterpart—International Search Report and Written Opinion, dated Dec. 8, 2016, PCT/US2016/034362, filed on May 26, 2016.
Foreign Communication from a Related Counterpart—International Search Report and Written Opinion, dated May 1, 2018, PCT/US2017/057674, filed on Oct. 20, 2017.
Foreign Communication from a Related Counterpart—International Search Report and Written Opinion, dated Jul. 23, 2018, PCT/US2018/033875, filed on May 22, 2018.
Mak, John, "Flexible NGL Recovery and Methods," filed Oct. 20, 2003, U.S. Appl. No. 60/516,120.
Mak, John, "Ethane Recovery and Ethane Rejection Methods and Configurations," filed Dec. 23, 2010, U.S. Appl. No. 61/426,756.
Mak, John, "Ethane Recovery and Ethane Rejection Methods and Configurations," filed Jan. 21, 2011, U.S. Appl. No. 61/434,887.
Mak, John, "Configurations and Methods for Retrofitting NGL Recovery Plant," filed Jun. 20, 2011, U.S. Appl. No. 61/499,033.
Mak, John, "Configurations and Methods for NGL Recovery for High Nitrogen Content Feed Gases," filed Sep. 20, 2012, U.S. Appl. No. 61/703,654.
Mak, John, "Flexible NGL Recovery Methods and Configurations," filed Mar. 14, 2013, U.S. Appl. No. 61/785,329.
Mak, John, "Methods and Configuration of an NGL Recovery Process for Low Pressure Rich Feed Gas," filed Feb. 9, 2015, U.S. Appl. No. 62/113,938.
Mak, John, "Phase Implementation of Natural Gas Liquid Recovery Plants," filed Oct. 20, 2017, U.S. Appl. No. 15/789,463.
Mak, John, "Phase Implementation of Natural Gas Liquid Recovery Plants," filed Oct. 20, 2017, International Application No. PCT/US2017/057674.
Extended European Search Report dated Aug. 8, 2019, European Patent Application No. 16884122.9.
Communication Pursuant to Rules 70(2) and 70a(2) EPC dated Aug. 27, 2019, European Patent Application No. 16884122.9.
Corrected Notice of Allowability dated Jul. 2, 2019, U.S. Appl. No. 15/259,354, filed Sep. 8, 2016.
Office Action dated Jun. 14, 2019, Canadian Application No. 2,839,132, filed on Dec. 11, 2013.
Notice of Decision dated Sep. 30, 2019, United Arab Emirates Patent Application No. P1023/2015 filed Mar. 14, 2014.
Extended European Search Report dated Aug. 1, 2018, European Patent Application filed Feb. 9, 2016.
Communication Pursuant to Rules 70(2) and 70a(2) EPC dated Aug. 20, 2018, European Patent Application filed Feb. 9, 2016.
Restriction Requirement dated Sep. 18, 2019, U.S. Appl. No. 15/789,463, filed Oct. 20, 2017.
PCT International Preliminary Report on Patentability dated Jun. 24, 2021; International Application No. PCT/US2019/065993 filed Dec. 12, 2019.
Final Office Action dated Aug. 9, 2021, U.S. Appl. No. 16/219,126, filed Dec. 13, 2018.
Office Action dated Apr. 13, 2021, Saudi Arabian Patent Application No. 51891931 filed Jan. 15, 2016.
Notice of Allowance dated Apr. 27, 2021, U.S. Appl. No. 15/789,463, filed Oct. 20, 2017.
Office Action dated Jan. 29, 2021, U.S. Appl. No. 16/219,126, filed Dec. 13, 2018.
Office Action dated Feb. 24, 2021, Canadian Patent Application No. 3008229 filed Jan. 15, 2016.
Area 4, "Reboilers", found at: https://www.area4.info/Area4%20Informations/REBOILERS.htm.
Office Action dated Mar. 1, 2019, U.S. Appl. No. 15/259,354, filed Sep. 8, 2016.
Final Office Action dated Mar. 6, 2019, U.S. Appl. No. 15/191,251, filed Jun. 23, 2016.
International Search Report and Written Opinion, dated Dec. 12, 2017, PCT/US2017/0050636, filed on Sep. 8, 2017.
Mak, John et al., "Methods and Configuration for Retrofitting NGL Plant for High Ethane Recovery." filed Sep. 9, 2016, U.S. Appl. No. 62/385,748.
Mak, John et al., "Methods and Configuration for Retrofitting NGL Plant for High Ethane Recovery." filed Feb. 14, 2019, U.S. Appl. No. 15/325,696.
Mak, John, et al., "Integrated Methods and Configurations for Ethane Rejection and Ethane Recovery," filed May 22, 2018, Application No. PCT/US2018/033875.

(56) References Cited

OTHER PUBLICATIONS

European Patent Application No. 16884122.9, Communication pursuant to Rules 161 and 162 EPC, mailed Aug. 20, 2018, 3 pages.
Foreign Communication from a Related Counterpart—International Preliminary Report On Patentability, dated Nov. 29, 2018, PCT/US2016/034362, filed on May 26, 2016.
Notice of Allowance dated Jan. 24, 2019, U.S. Appl. No. 15/158,143, filed May 16, 2016.
Office Action dated Sep. 22, 20202, U.S. Appl. No. 16/219,126, filed Dec. 13, 2018.
International Preliminary Report on Patentability, dated Dec. 3, 2020, PCT/US2018/033875, filed on May 22, 2018.
International Application No. PCT/US2019/065993 filed Dec. 12, 2019, PCT Search Report and Written Opinion dated Apr. 9, 2020.
Editors: Mokhatab, S.; Poe, W. A. Poe; Spe, J. G. Handbook of Natural Gas Transmission and Processing (Elsevier, 2006, ISBN U 978-0-7506-7776-9, pp. 365-400), Chapter 10, pp. 365-400.
Restriction Requirement dated May 12, 2017, U.S. Appl. No. 14/988,388, filed Jan. 5, 2016.
Office Action dated Aug. 10, 2017, U.S. Appl. No. 14/988,388, filed Jan. 5, 2016.
Final Office Action dated Nov. 29, 2017, U.S. Appl. No. 14/988,388, filed Jan. 5, 2016.
Notice of Allowance dated Feb. 16, 2018, U.S. Appl. No. 14/988,388, filed Jan. 5, 2016.
U.S. Appl. No. 10/469,456, Office Action, mailed Sep. 19, 2005, 6 pages.
U.S. Appl. No. 10/469,456, Notice of Allowance, mailed Jan. 10, 2006, 6 pages.
Europe Patent Application No. 02731911.0, Supplementary European Search Report, mailed Nov. 24, 2005, 3 pages.
Europe Patent Application No. 02731911.0, Examination Report, mailed Mar. 2, 2006, 5 pages.
Europe Patent Application No. 02731911.0, Examination Report, mailed Sep. 19, 2006, 4 pages.
Europe Patent Application No. 02731911.0, Intention to Grant, mailed Aug. 1, 2007, 20 pages.
Europe Patent Application No. 02731911.0, Decision to Grant, mailed Dec. 13, 2007, 2 pages.
Canada Patent Application No. 2484085, Examination Report, mailed Jan. 16, 2007, 3 pages.
First Office Action dated Dec. 14, 2007, CN Application No. 200480039552.8 filed Oct. 30, 2003.
Second Office Action dated Nov. 7, 2008, CN Application No. 200480039552.8 filed Oct. 30, 2003.
Notice of Decision to Grant dated Jul. 31, 2009, CN Application No. 200480039552.8 filed Oct. 30, 2003.
Examination Report dated Dec. 19, 2012, EP Application No. 04794213.1 filed Oct. 4, 2004.
Second Examination Report dated Oct. 7, 2014, EP Application No. 04794213.1, filed Oct. 4, 2004.
Office Action dated Jan. 7, 2009, JP Application No. 2006538016, priority date Oct. 30, 2003.
Decision to Grant dated Aug. 20, 2010, JP Application No. 2006538016, priority date Oct. 30, 2003.
Office Action dated Aug. 4, 2010, U.S. Appl. No. 10/595,528, filed Feb. 28, 2007.
Final Office Action dated Dec. 29, 2010, U.S. Appl. No. 10/595,528, filed Feb. 28, 2007.
Advisory Action dated Apr. 14, 2011, U.S. Appl. No. 10/595,528, filed Feb. 28, 2007.
Office Action dated Jun. 8, 2011, U.S. Appl. No. 10/595,528, filed Feb. 28, 2007.
Final Office Action dated Oct. 27, 2011, U.S. Appl. No. 10/595,528, filed Feb. 28, 2007.
Notice of Allowance dated Mar. 5, 2012, U.S. Appl. No. 10/595,528, filed Feb. 28, 2007.
Europe Patent Application No. 08795331.1, Communication pursuant to Rules 161 and 162 EPC, mailed Mar. 24, 2010, 2 pages.
China Patent Application No. 200880103754.2, First Office Action, dated Mar. 27, 2012, 20 pages.
China Patent Application No. 200880103754.2, Second Office Action, dated Dec. 26, 2012, 21 pages.
China Patent Application No. 200880103754.2, Third Office Action, dated Jul. 22, 2013, 7 pages.
China Patent Application No. 200880103754.2, Notification to Grant Patent Right for Invention, dated Dec. 23, 2013, 2 pages.
Australia Patent Application No. 2008287322, First Examination Report, dated Apr. 8, 2011, 2 pages.
Australia Patent Application No. 2008287322, Notice of Acceptance, dated Apr. 4, 2012, 1 page.
Gulf Cooperation Council Patent Application No. GCC/P/2008/11533, Examination Report, dated Dec. 19, 2013, 4 pages.
Canada Patent Application No. 2694149, Office Action, dated Apr. 16, 2012, 2 pages.
U.S. Appl. No. 12/669,025, Office Action, mailed May 8, 2012, 12 pages.
U.S. Appl. No. 12/669,025, Office Action, mailed Oct. 10, 2013, 11 pages.
U.S. Appl. No. 12/669,025, Final Office Action, mailed Mar. 4, 2014, 10 pages.
U.S. Appl. No. 12/669,025, Notice of Allowance, mailed Apr. 7, 2015, 12 pages.
Mexico Patent Application No. MX/a/2010/001472, Office Action, dated Nov. 15, 2013, 1 page.
Mexico Patent Application No. MX/a/2010/001472, Office Action, dated Jul. 23, 2014, 1 page.
United Arab Emirates Patent Application No. 0143/2010, Search Report, dated Oct. 3, 2015, 9 pages.
Restriction Requirement dated Sep. 22, 2015, U.S. Appl. No. 13/996,805, filed Sep. 17, 2013.
Office Action dated Feb. 9, 2016, U.S. Appl. No. 13/996,805, filed Sep. 17, 2013.
Notice of Allowance dated Jun. 9, 2016, U.S. Appl. No. 13/996,805, filed Sep. 17, 2013.
Restriction Requirement dated Sep. 12, 2018, U.S. Appl. No. 15/259,354, filed Sep. 8, 2016.
Australian Application No. 2011349713, Examination Report, dated Dec. 16, 2014, 2 pages.
Australia Application No. 2011349713, Notice of Acceptance, dated Mar. 31, 2015, 2 pages.
Restriction Requirement dated Jan. 8, 2014, U.S. Appl. No. 13/528,332, filed Jun. 20, 2012.
Notice of Allowance dated Aug. 15, 2014, U.S. Appl. No. 13/528,332, filed Jun. 20, 2012.
Examination Report dated Mar. 17, 2016, AU Application No. 2012273028, priority date Jun. 20, 2011.
Office Action dated Dec. 9, 2019, U.S. Appl. No. 15/988,310, filed May 24, 2018.
Office Action dated Dec. 3, 2019, Canadian Patent Application No. 2976071 filed Feb. 9, 2016.
Notice of Allowance dated Jun. 19, 2019, U.S. Appl. No. 15/259,354, filed Sep. 8, 2016.
Office Action dated Apr. 4, 2019, U.S. Appl. No. 14/033,096, filed Sep. 20, 2013.
Office Action dated Mar. 21, 2019, Canadian Patent Application No. 2976071.
International Preliminary Report on Patentability, dated Mar. 21, 2019, PCT/US2017/0050636, filed on Sep. 8, 2017.
Notice of Allowance dated Mar. 13, 2020, U.S. Appl. No. 15/988,310, filed May 24, 2018.
International Preliminary Report on Patentability, dated Apr. 30, 2020, PCT/US2017/057674, filed on Oct. 20, 2017.
Notice of Allowance dated May 19, 2020, Canadian Patent Application No. 2976071 filed Feb. 9, 2016.
Office Action dated May 4, 2020, U.S. Appl. No. 15/789,463, filed Oct. 20, 2017.
Notice of Allowance dated Aug. 20, 2021, Canadian Patent Application No. 3008229 filed Jan. 15, 2016.
Office Action dated Jul. 29, 2021, Canadian Patent Application No. 3084911 filed Jun. 20, 2012.

(56) References Cited

OTHER PUBLICATIONS

Office Action dated Dec. 20, 2021, Canadian Patent Application No. 3084911 filed Jun. 20, 2012.
Office Action dated Nov. 4, 2021, U.S. Appl. No. 16/390,687, filed Apr. 22, 2019.
Office Action dated Sep. 9, 2021, Mexican Patent Application No. MX/a/2016/009162 filed Jul. 13, 2016.
Advisory Action dated Nov. 16, 2021, U.S. Appl. No. 16/219,126, filed Dec. 13, 2018.
Office Action dated Dec. 29, 2021, Saudi Arabian Patent Application No. 51891931 filed Jan. 15, 2016.
Office Action dated Dec. 13, 2021, Australian Patent Application filed May 18, 2016.
Office Action dated Dec. 21, 2021, Brazilian Patent Application filed Sep. 8, 2017.
Notice of Allowance dated Feb. 24, 2022, U.S. Appl. No. 16/390,687, filed Apr. 22, 2019.
Notice of Allowance dated Mar. 7, 2022, Mexican Patent Application No. MX/a/2016/009162 filed Jul. 13, 2016.
Office Action dated Mar. 16, 2022, U.S. Appl. No. 16/325,696, filed Feb. 14, 2019.
Office Action dated Mar. 11, 2022, U.S. Appl. No. 16/421,138, filed May 23, 2019.
Final Office Action dated Jun. 17, 2022, U.S. Appl. No. 16/421,138, filed May 23, 2019.
Examiner's Answer to Appeal Brief dated Jun. 2, 2022, U.S. Appl. No. 16/219,126, filed Dec. 13, 2018.
Notice of Allowance dated Feb. 20, 2024, Canadian Patent Application No. 3033088 filed Feb. 5, 2019.
Notice of Allowance dated Feb. 26, 2024, Canadian Patent Application No. 3077409 filed Oct. 20, 2017.
Appeal Board Decision dated Mar. 21, 2024, U.S. Appl. No. 16/219,126, filed Dec. 13, 2018.
Notice of Allowance dated Apr. 19, 2024, U.S. Appl. No. 16/219,126, filed Dec. 13, 2018.
Notice of Acceptance dated Jun. 6, 2023, Brazilian Patent Application filed Sep. 8, 2017.
Office Action dated Oct. 19, 2023, Canadian Patent Application No. 3033088 filed Feb. 5, 2019.
Office Action dated Aug. 29, 2023, Mexican Application No. MX/a/2019/001888, filed Feb. 15, 2019.
Notice of Allowance dated Jan. 19, 2024, Mexican Application No. MX/a/2019/001888, filed Feb. 15, 2019.
Office Action dated Jan. 16, 2024, U.S. Appl. No. 18/348,557, filed Jul. 7, 2023.
Office Action dated Oct. 30, 2023, Canadian Patent Application No. 3077409 filed Oct. 20, 2017.
Office Action dated Apr. 27, 2023, U.S. Appl. No. 17/393,477, filed Aug. 4, 2021.
Final Office Action dated Nov. 9, 2023, U.S. Appl. No. 17/393,477, filed Aug. 4, 2021.
Advisory Action dated Jan. 25, 2024, U.S. Appl. No. 17/393,477, filed Aug. 4, 2021.
Final Office Action dated Mar. 3, 2023, U.S. Appl. No. 17/054,195, filed Nov. 10, 2020.
Examiner"s Answer dated Nov. 8, 2023, U.S. Appl. No. 17/054,195, filed Nov. 10, 2020.
Office Action dated Nov. 16, 2023, Canadian Patent Application No. 3,122,425 filed Oct. 20, 2017.
Office Action dated Aug. 19, 2022, Canadian Patent Application No. 3084911 filed Jun. 20, 2012.
Office Action dated Jun. 7, 2022, Brazilian Patent Application filed Sep. 8, 2017.
Final Office Action dated Jul. 5, 2022, U.S. Appl. No. 16/325,696, filed Feb. 14, 2019.
Office Action dated Jun. 20, 2022, Saudi Arabia Patent Application No. 520411793 filed Oct. 20, 2017.
Office Action dated Aug. 24, 2022, Argentine Patent Application No. 20190101360 filed May 22, 2019.
Office Action dated Sep. 4, 2022, Saudi Arabian Patent Application No. 520420584 filed May 22, 2018.
Communication Pursuant to Rule 70(2) and 70a(2) EPC dated Sep. 6, 2022, European Patent Application No. 19895601.3 filed Dec. 12, 2019.
Advisory Action dated Sep. 19, 2022, U.S. Appl. No. 16/325,696, filed Feb. 14, 2019.
Advisory Action dated Sep. 1, 2022, U.S. Appl. No. 16/421,138, filed May 23, 2019.
Notice of Acceptance dated Oct. 27, 2022, Australian Patent Application filed May 18, 2016.
Notice of Allowance dated Nov. 15, 2022, Canadian Patent Application No. 3022085 filed May 18, 2016.
Office Action dated Nov. 1, 2022, Brazilian Patent Application filed Sep. 8, 2017.
Restriction Required dated Oct. 26, 2021, U.S. Appl. No. 16/325,696, filed Feb. 14, 2019.
Pre-Appeal Brief Decision dated Nov. 18, 2022, U.S. Appl. No. 16/325,696, filed Feb. 14, 2019.
Notice of Allowance dated Nov. 18, 2022, U.S. Appl. No. 16/325,696, filed Feb. 14, 2019.
Notice of Allowance dated Nov. 17, 2022, Canadian Patent Application No. 3047703 filed Feb. 9, 2017.
Notice of Grant dated Dec. 27, 2022, Saudi Arabia Patent Application No. 520411793 filed Oct. 20, 2017.
Restriction Requirement dated Sep. 22, 2022, U.S. Appl. No. 17/393,477, filed Aug. 4, 2021.
Notice of Non-Compliant Amendment dated Nov. 17, 2022, U.S. Appl. No. 17/393,477, filed Aug. 4, 2021.
Office Action dated Oct. 27, 2022, U.S. Appl. No. 17/054,195, filed Nov. 10, 2020.
Examiner's Answer to Appeal Brief dated Feb. 14, 2023, U.S. Appl. No. 16/421,138, filed May 23, 2019.
Notice of Financial Consideration of Grants dated Sep. 19, 2022, Saudi Arabian Patent Application No. 51891931 filed Jan. 15, 2016.
Restriction Requirement dated Aug. 23, 2022, U.S. Appl. No. 17/054,195, filed Nov. 10, 2020.
Office Action dated May 31, 2024, U.S. Appl. No. 17/393,477, filed Aug. 4, 2021.
Appeal Board Decision dated Jun. 24, 2024, U.S. Appl. No. 16/421,138, filed May 23, 2019.

| Stream No. | 1 | 16 | 24 |
|---|---|---|---|
| Stream | Feed Gas | C2+NGL | Sales Gas |
| Component Mole% | | | |
| N2 | 0.28 | 0.00 | 0.32 |
| Methane | 71.75 | 0.00 | 81.90 |
| Ethane | 15.46 | 0.15 | 17.72 |
| Propane | 7.56 | 61.12 | 0.01 |
| i-Butane | 0.89 | 7.27 | 0.00 |
| n-Butane | 2.31 | 18.80 | 0.00 |
| i-Pentane | 0.56 | 4.52 | 0.00 |
| n-Pentane | 0.66 | 5.38 | 0.00 |
| | | | |
| Temperature, F° | 104 | 210 | 86 |
| Pressure, psig | 926 | 405 | 868 |
| lb/h | 1,496,869 | 420,923 | 1,076,025 |
| lb mole/h | 66,079 | 8,146 | 57,902 |

FIG. 2

FIG. 4

| Stream No. | 1 | 16 | 24 |
|---|---|---|---|
| Stream | Feed Gas | C2+NGL | Sales Gas |
| Component Mole% | | | |
| N2 | 17.47 | 0.00 | 21.30 |
| Methane | 63.99 | 0.13 | 77.94 |
| Ethane | 11.03 | 58.86 | 0.70 |
| Propane | 4.64 | 25.95 | 0.04 |
| i-Butane | 0.49 | 2.75 | 0.00 |
| n-Butane | 1.22 | 6.84 | 0.00 |
| i-Pentane | 0.23 | 1.29 | 0.00 |
| n-Pentane | 0.27 | 1.52 | 0.00 |
| | | | |
| Temperature, F° | 102 | 83 | 88 |
| Pressure, psig | 934 | 364 | 1052 |
| lb/h | 1,423,940 | 442,713 | 979,485 |
| lb mole/h | 63,810 | 11,352 | 52,356 |

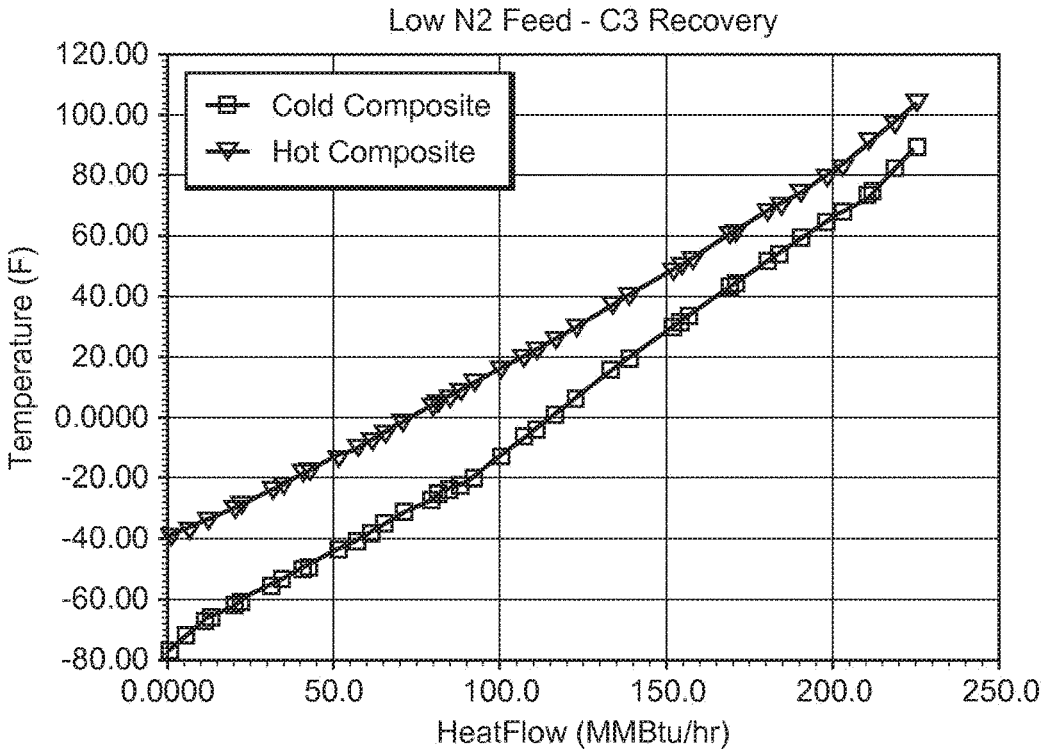
FIG. 5
FIG. 6
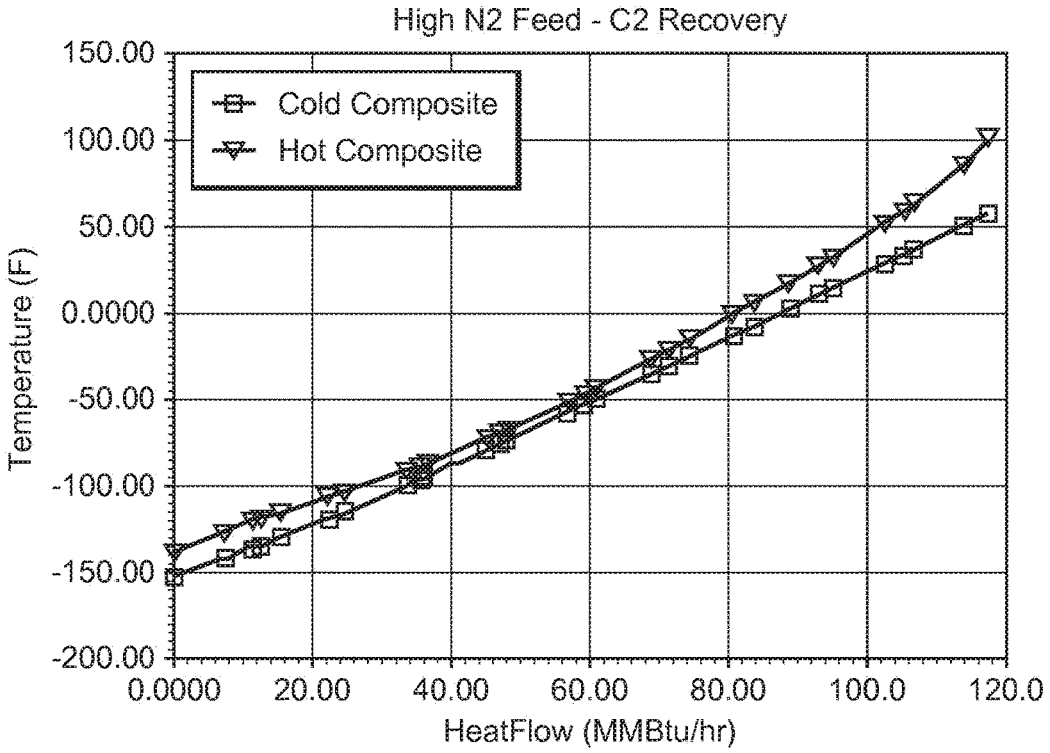

CONFIGURATIONS AND METHODS FOR NGL RECOVERY FOR HIGH NITROGEN CONTENT FEED GASES

CROSS-REFERENCE TO RELATED APPLICATIONS

This application is a continuation of and claims priority to U.S. patent application Ser. No. 14/033,096 filed on Sep. 20, 2013, which claims priority to U.S. Provisional Patent Application Ser. No. 61/703,654, filed Sep. 20, 2012, all of which are incorporated by reference herein in their entireties.

FIELD OF THE INVENTION

The field of the invention is natural gas processing, more specifically, conversion of a low nitrogen feed gas plant operating on $C_3$ recovery to a high nitrogen feed gas plant operating on $C_2$ recovery.

BACKGROUND OF THE INVENTION

The following description includes information that may be useful in understanding the present invention. It is not an admission that any of the information provided herein is prior art or relevant to the presently claimed invention, or that any publication specifically or implicitly referenced is prior art.

Natural gas is a hydrocarbon gas mixture that occurs in nature and can be found under deep underground rock formations. The exact composition of natural gas varies from source to source and can comprise different percentages of hydrocarbons (e.g., methane, ethane, propane, and butane), as well as other constituents (e.g., carbon dioxide, oxygen, nitrogen, and hydrogen sulphide).

Before natural gas can be used as an energy source, it must be processed to remove impurities and to "recover" the desired hydrocarbons, meaning that the desired hydrocarbons are separated by kind and converted into separate streams of liquid natural gas (LNG). Numerous natural gas separation processes and systems, referred to herein as "NGL plants," are known. In a typical NGL plant, a pressurized feed gas stream originating from a natural gas source is cooled by a heat exchanger, typically using propane refrigeration when the feed gas is rich. As the feed gas stream is cooled, the heavier hydrocarbons (e.g., ethane, propane, butane) condense from the cooled gas and form a liquid stream. The liquid stream is then separated from the gas stream and expanded with a turbo expander and fractionated in distillation columns (e.g., de-deethanizer or demethanizer) to further separate lighter components (e.g., methane, nitrogen, volatile gases) as overhead vapor from the heavier components. The system parameters for a NGL plant (e.g., volumetric flow rates, temperatures, pressures) will vary depending on the particular composition and condition (e.g., pressure, temperature) of the natural gas being processed. System parameters will also vary depending on the desired hydrocarbons that need to be recovered (e.g., methane, ethane, propane, etc.). As long as the feed gas composition does not deviate significantly from the system parameters, known separation processes can achieve high recovery levels.

Crude oil and natural gas are often found together in the same reservoir, such as a crude oil well. In such cases, the crude oil extraction process can be enhanced by injecting nitrogen into the reservoir. Consequently, the nitrogen content in the natural gas increases over time. This increase in nitrogen can reduce the operational efficiency and recovery levels of the NGL plant over time. For example, NGL plants are typically designed to process feed gas with a nitrogen content of 1 to 2 mole % or lower. As the enhanced crude oil recovery process continues, the nitrogen content can be increased to 17 to 20 mole % and higher. The high nitrogen content dilutes the feed gas and changes the temperature profile of the NGL plant, which reduces NGL recovery levels and plant processing capacity. Thus, there is a need for new NGL plant designs that provide high LNG recovery levels even as nitrogen content of the natural gas increases over time.

The challenge of processing natural gas as nitrogen content increases is further exuberated by the fact that, in some cases, NGL plants are required to recover both ethane ($C_2$) and propane ($C_3$). Typically, $C_2$ recovery processes employ a single distillation column, which usually has a reflux to increase $C_2$ recovery, such as illustrated in: U.S. Pat. No. 4,519,824 issued to Huebel; U.S. Pat. No. 4,278,457 issued to Campbell et al.; and U.S. Pat. No. 4,157,904 issued to Campbell et al. However, when $C_3$ is desired, the recovery processes consist of two columns: one column operating as an absorber and the other column operating as a deethanizer column. The design configuration and system parameters for NGL plants can differ significantly, depending on $C_3$ recovery or $C_2$ recovery is desired.

Some NGL plants are designed to switch between a $C_2$ recovery mode and $C_2$ rejection mode (e.g., $C_3$ recovery mode). For example, U.S. Pat. No. 7,051,553 to Mak et al, describes a twin reflux NGL plant/process that can switch between a C2 recovery mode and C3 recovery mode. In particular the NGL plant has a first column that receives two reflux streams: one reflux stream comprises a vapor portion of the NGL and the other reflux stream comprises a lean reflux provided by the overhead of a second column. While such a process can accommodate variations in ethane recovery levels (e.g., by switching from $C_3$ recovery mode to $C_2$ recovery mode), it nevertheless is limited to the feed gas composition and would require significant process modifications if the nitrogen content in the feed gas is increased to over 20%.

Thus, although various configurations and methods for NGL plants are known, such configurations are not well suited to handle the increase in nitrogen content that occurs during enhanced oil recovery in crude oil wells, especially the NGL plant is required to switch from a $C_3$ recovery mode to a $C_2$ recovery mode.

Therefore, there is still a need to provide methods and configurations for improved LNG recovery, especially for crude oil reservoirs that contain both oil and natural gas.

SUMMARY OF THE INVENTION

The inventor has discovered that a high $C_3$ recovery process designed for a low nitrogen content feed gas, typically 1 to 2 mole %, can be converted to a high $C_2$ recovery process for a high nitrogen content feed gas, typically 17 to 20 mole % or higher to achieve over 95% ethane recovery while maintaining over 99% propane recovery, in which $C_3$ refrigeration is used to provide reflux to the deethanizer during $C_3$ recovery and is converted to provide feed gas chilling during $C_2$ recovery.

In one aspect of some embodiments, NGL plants and methods employ a two-column NGL recovery configuration having an absorber and a fractionation column that are used for both $C_2$ recovery and $C_3$ recovery. The absorber is configured to receive at least two alternate reflux streams, wherein one reflux stream is drawn from an overhead vapor and/or liquid from the distillation column during $C_3$ recovery and wherein the other reflux streams are drawn from the chilled residue gas and the chilled feed gas during $C_2$ recovery. Such contemplated methods allow conversion of a $C_3$ recovery plant to a $C_2$ recovery plant when the feed gas nitrogen content increases from 1 mole % to over 20 mole %.

Viewed from a different perspective, it should be recognized that contemplated methods and configurations effectively utilize propane refrigeration to provide refluxes to the absorber and fractionation column during $C_3$ recovery and can be converted to provide refluxes with chilled feed gas and residue gas during $C_2$ recovery, wherein the overhead vapor from the fractionation column is re-routed to the absorber bottom.

Contemplated methods advantageously recover the refrigerant content of the liquids from the expander suction separator and the absorber bottom by chilling the feed gas during propane recovery, wherein these liquids are directly returned to the columns during ethane recovery.

In some configurations, during ethane recovery about 20% to 30% of the feed gas is chilled, bypassing the expander, and is provided as reflux to the absorber. In addition, about 10% to 50% of the total residue gas is chilled, providing a second reflux to the absorber, whereby, about 95% $C_2$ is recovered while maintaining over 99% $C_3$ recovery.

Contemplated configurations are especially advantageous in application to NGL recovery plants that require $C_3$ recovery in the initial operation with a low nitrogen content gas and are then converted to recover $C_2$ with a high nitrogen feed gas in the later phase.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 2 is a heat and mass table for the process shown in FIG. 1.

FIG. 4 is a heat and mass table for the process shown in FIG. 3.

FIG. 5 is heat composite curve for core exchanger 51 operating in the $C_3$ recovery mode with a low nitrogen content feed gas according to the inventive subject matter.

FIG. 6 is heat composite curve for core exchanger 51 operating in the $C_2$ recovery mode with a high nitrogen content feed gas according to the inventive subject matter.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
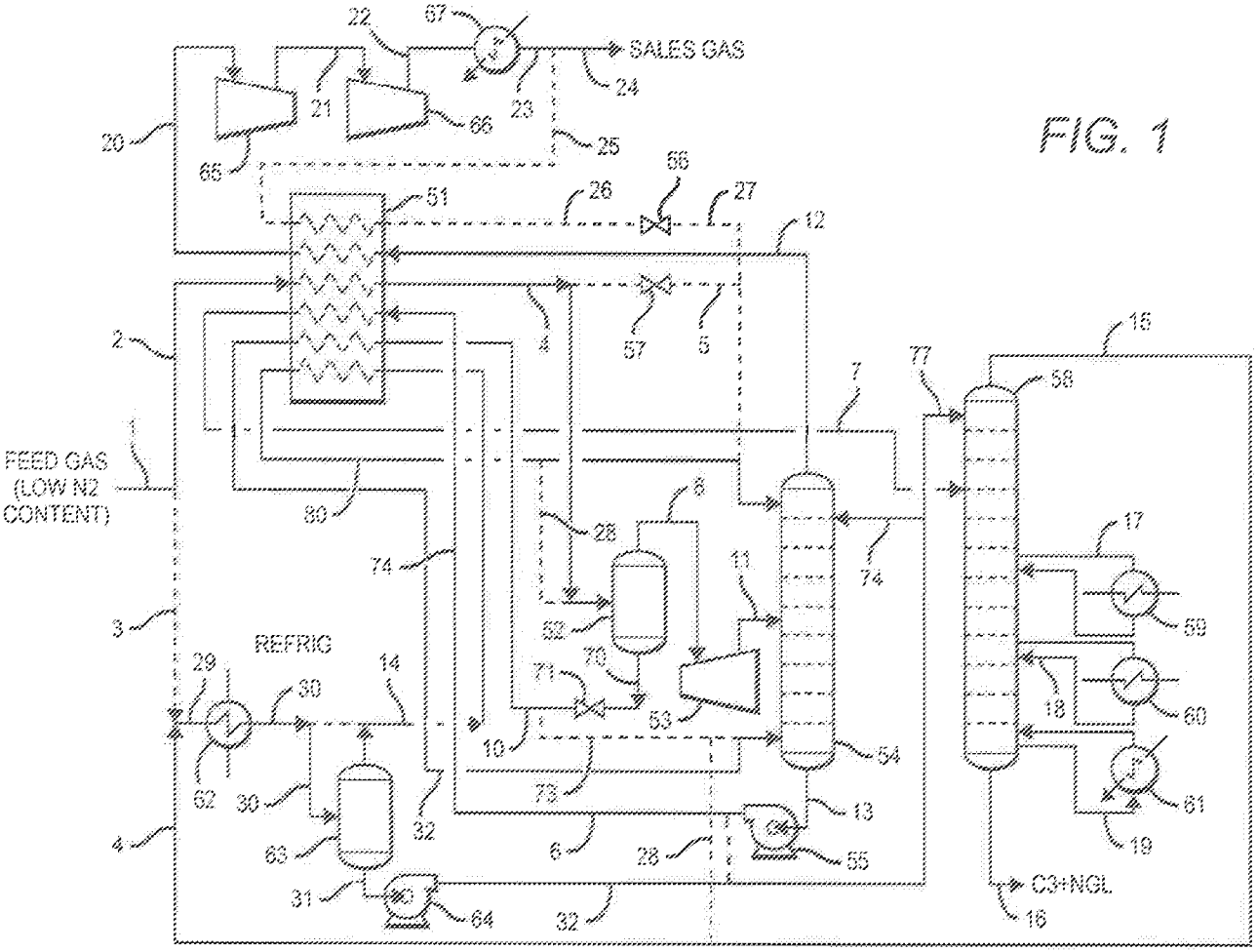
FIG. 1 is a schematic of one exemplary process and configuration for $C_3$ recovery with a low nitrogen content feed gas according to the inventive subject matter. The solid lines pertain to the $C_3$ recovery operation while the fathom lines pertain to the $C_2$ recovery operation.

FIG. 1 shows an exemplary $C_3$ recovery process, in which feed gas 1 enters an NGL plant at 100° F. and about 900 psig, with a feed gas composition as shown in the overall heat and mass table of FIG. 2. Feed gas stream 2 is cooled to about −40° F. by heat exchange with residual gas stream 12 from the absorber, forming stream 4 which is separated in separator 52, producing liquid stream 70, and vapor stream 8. Vapor stream 8 is expanded in expander 53 to about 430 psig, forming stream 11 at about −95° F., which is fed to the lower section of absorber 54. The power produced from expander 53 is used to drive re-compressor 65. Liquid stream 70 is let down in pressure in JT valve 71 to about 430 psig, forming stream 10 at about −75° F., and is then heated to −20° F. by the feed gas in exchanger 51, forming stream 32, prior to feeding to the bottom of absorber 54.

Absorber 54 is refluxed with two streams; liquid stream 74 and the vapor stream 80, producing an ethane depleted overhead stream 12 at −60° F., and an ethane rich bottom stream 13 at 25° F. The refrigerant content in the overhead stream 12 is recovered by chilling the feed gas 1, and the bottom stream 13 is pumped by pump 55 and heated by feed gas 1 to about 90° F., forming stream 7, prior to entering the mid-section of fractionator 58. The fractionator produces an ethane rich overhead stream 15 at 16° F., and a propane rich bottom stream 16 at 210° F. Side reboilers 59 and 60 are used to reduce the reboiler duty for energy conservation while the fractionator 58 bottom temperature is controlled by reboiler 61, maintaining the ethane content in stream 16 (NGL) to below 0.01 mole %.

The fractionator overhead stream 15 is cooled by propane refrigeration in chiller 62 to about −20° F., forming stream 30, which is separated in separator 63 into vapor stream 14 and liquid stream 31, supplying refluxes for absorber 54 and fractionator 58.

Overall heat and material balance for the $C_3$ recovery process is shown in the table of FIG. 2.

Figure 3:
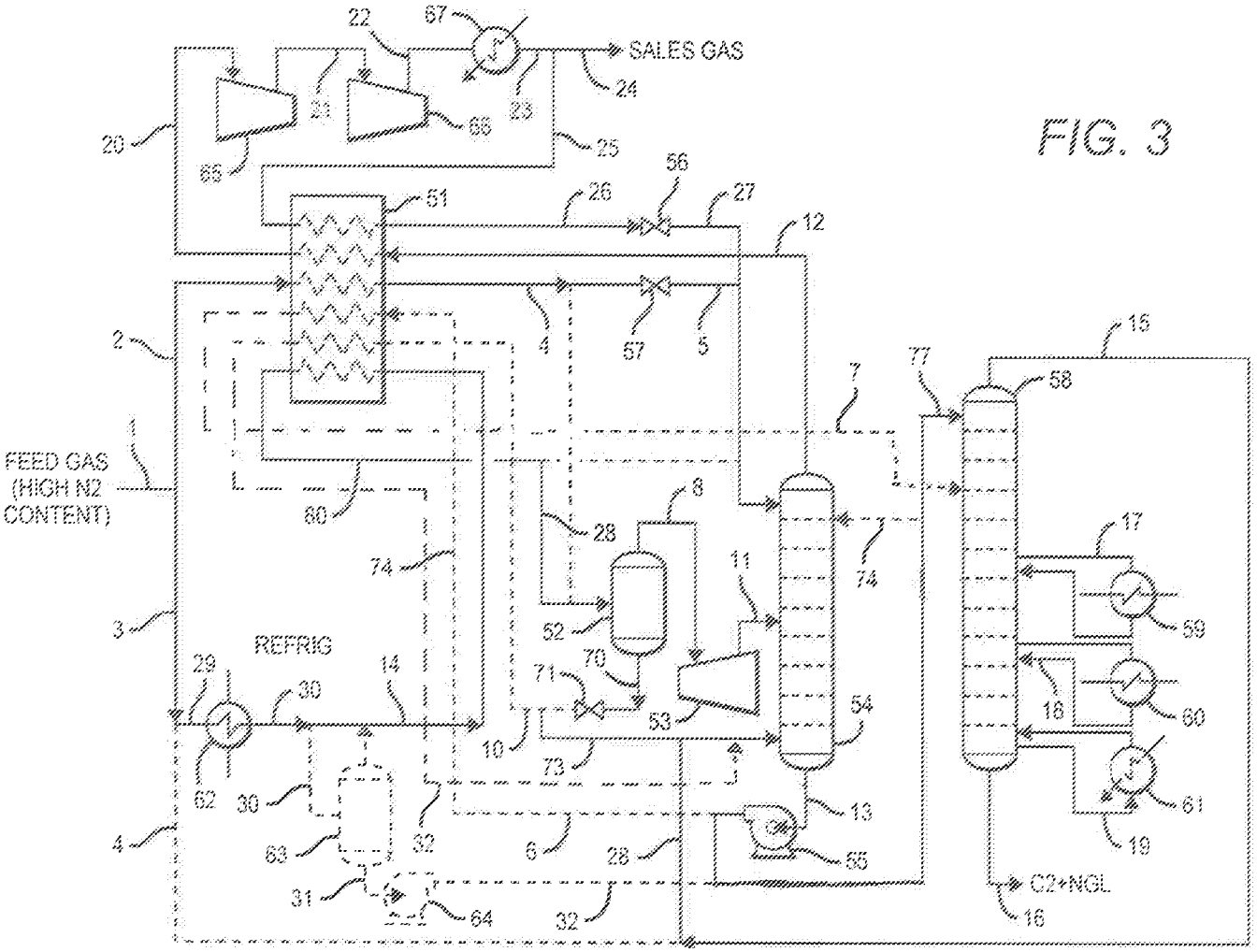
FIG. 3 is a schematic of one exemplary process and configuration for $C_2$ recovery with a high nitrogen content feed gas according to the inventive subject matter. The solid lines pertain to the $C_2$ recovery operation while the fathom lines pertain to the $C_3$ recovery operation.

FIG. 3 shows an exemplary $C_2$ recovery process, in which feed gas 1 enters a NGL plant at 100° F. and about 900 psig, with a feed gas composition as shown in the overall heat and mass table of FIG. 4. Feed gas stream 1 is split into two portions, stream 2 and stream 3, where stream 2 constitutes about 20% to 30% of the total feed gas rate, and is cooled by the residue gas in exchanger 51.

The other portion, stream 3, is cooled by propane chiller 62 to about −22° F., forming stream 30, which is further cooled in exchanger 51 to about −40° F., forming stream 80, which is separated in separator 52, producing liquid stream 70 and vapor stream 8. Vapor stream 8 is expanded in expander 53 to about 430 psig, forming stream 11 at about −105° F., which is fed to the lower section of absorber 54.

The power produced from expander 53 is used to drive re-compressor 65. Liquid stream 70 is let down in pressure to about 450 psig in JT valve 71 and combined with the fractionator overhead vapor stream 15 and fed to the bottom section of absorber 54.

Absorber 54 is refluxed with two reflux streams, feed gas stream 5 and the residue gas recycle stream 27, producing an ethane depleted overhead stream 12 at −150° F., and an ethane rich bottom stream 13 at −66° F. The absorber overhead stream 12 is used in chilling the feed gas stream 2 and residue gas recycle stream 25 in exchanger 51, and the absorber bottom stream 13 is pumped by pump 55 and is sent to fractionator 58 as reflux stream 77. Fractionator 58 produces an ethane depleted overhead stream 15 and ethane rich bottom stream 16. Side reboilers 59 and 60 are used to reduce reboiler duty for energy conservation, and the temperature of the bottom liquid in fractionator 58 is maintained at 82° F. by reboiler 61, maintaining the methane content in stream 16 (NGL) to below 0.01 mole %.

Overall heat and material balance for the high nitrogen feed gas operation on $C_2$ recovery is shown in the table of FIG. 4.

It should be particularly appreciated that the contemplated configurations shown in FIGS. 1 and 3 may be used for high nitrogen feed gases for either ethane or propane recovery by repositioning valves and piping. Alternatively, a NGL plant can be designed so that it is transitionable between a $C_2$ recovery mode and $C_3$ recovery mode with minimum impact on the process. For example, an NGL plant can be configured with piping and components represented by both the solid lines and the dotted lines in FIGS. 1 and 3, with valves at the intersections of solid and fathom lines. The valves can be operated manually or automatically to transition between recovery modes. In this manner, NGL plants can process a feed gas that has an increase in nitrogen content over time, such as the feed gas from a crude oil reservoirs that is processed using nitrogen-enhanced methods.

With the contemplated plant designs, $C_3$ recovery can be maintained at over 99% during the $C_3$ recovery mode, while $C_2$ recovery can be maintained at 95% while maintaining a 99% $C_3$ recovery. When $C_2$ recovery is required, the propane chiller is used for cooling a portion of the feed gas, and when $C_3$ recovery is desirable, the propane chiller is used as a reflux condenser for the absorber and fractionator.

When operating on $C_2$ recovery mode, the absorber bottom liquid stream is fed directly to the top tray of the fractionator column by valve switching, and when $C_3$ recovery is required, the absorber bottom stream is heated and routed to the mid-section of the fractionator. Thus, it should be noted that during $C_3$ recovery, the fractionator overhead vapor is chilled and partially condensed with propane refrigeration and the absorber bottoms, producing a vapor and liquid stream. The ethane rich vapor stream is further chilled by the absorber column overhead forming a reflux stream. During $C_2$ recovery, the fractionator overhead is routed to the bottom of the absorber for rectification and recovery of the ethane and heavier components.

With respect to suitable feed gas streams, it is contemplated that various feed gas streams are appropriate, and especially suitable fed gas streams may include various hydrocarbons of different molecular weight. With respect to the molecular weight of contemplated hydrocarbons, it is generally preferred that the feed gas stream predominantly includes $C_1$-$C_6$ hydrocarbons. However, suitable feed gas streams may additionally comprise acid gases (e.g., carbon dioxide, hydrogen sulfide) and other gaseous components (e.g., hydrogen). Consequently, particularly preferred feed gas streams are natural gas and natural gas liquids.

Thus, it should be especially recognized that in contemplated configurations, the cooling requirements for the first column are at least partially provided by product streams and recycle gas, and that the $C_2/C_3$ recovery can be varied by employing a different reflux stream. With respect to the $C_2$ recovery, it is contemplated that such configurations provide at least 85%, more preferably at least 90%, and most preferably at least 95% recovery, while it is contemplated that $C_3$ recovery will be at least 98%, more preferably at least 98%, and most preferably at least 99%. Further related configurations, contemplations, and methods are described in co-owned International Patent Applications with the publication numbers WO 2005/045338 and WO 2007/014069, both of which are incorporated by reference herein.

Thus, specific embodiments and applications of $C_2$ recovery and $C_2$ rejection configurations and methods therefore have been disclosed. It should be apparent, however, to those skilled in the art that many more modifications besides those already described are possible without departing from the inventive concepts herein. The inventive subject matter, therefore, is not to be restricted except in the spirit of the present disclosure. Moreover, in interpreting the specification and contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

The recitation of ranges of values herein is merely intended to serve as a shorthand method of referring individually to each separate value falling within the range. Unless otherwise indicated herein, each individual value with a range is incorporated into the specification as if it were individually recited herein. Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

What is claimed is:

1. A NGL plant configured to convert from a propane recovery configuration to an ethane recovery configuration, the NGL plant comprising:

an absorber;

a fractionator;

a first heat exchanger;

a separator;

an expander; and a chiller, wherein the absorber is configured to produce an absorber overhead product and an absorber bottom product, wherein the fractionator is configured to produce a fractionator overhead product and a fractionator bottom product, wherein in the propane recovery configuration:

the first heat exchanger is configured to cool a feed gas to form a cooled feed gas, the separator is configured to separate the cooled feed gas into a first vapor stream and a first liquid stream, the expander is configured to expand the first vapor stream to form an expanded first vapor stream, and wherein the expanded first vapor stream is directed to a mid-section of the absorber, and the first liquid stream is directed to a bottom of the absorber;

wherein in the ethane recovery configuration:

the feed gas is split into a first portion and a second portion, the first heat exchanger is configured to cool the first portion to form a cooled first portion, wherein the cooled first portion is fed to the absorber as a top reflux, the chiller is configured to chill the second portion of the feed gas utilizing propane refrigeration to form a chilled second portion, the first heat exchanger is configured to cool the chilled second portion to form a cooled second portion, the separator is configured to separate the cooled second portion into a second vapor stream and a second liquid stream, the expander is configured to expand the second vapor stream to form an expanded second vapor stream, and wherein the expanded second vapor stream is fed to the mid-section of the absorber, and the second liquid stream is fed to the bottom of the absorber.

2. The NGL plant of claim 1, wherein, in the propane recovery configuration, the NGL plant is configured to let the first liquid stream down in pressure and then heat the first liquid stream prior to flowing to the bottom of the absorber, and wherein, in the ethane recovery configuration, the NGL plant is configured to let the second liquid stream down in pressure and combine the second liquid stream with the fractionator overhead product prior to flowing to the bottom of the absorber in the ethane recovery configuration.

3. The NGL plant of claim 1, wherein the absorber is configured to receive a vapor portion of the fractionator overhead product as the top reflux in the propane recovery configuration and to receive a first portion of the absorber overhead product as part of the top reflux in the ethane recovery configuration;

wherein the fractionator overhead product is configured to flow to the chiller in the propane recovery configuration and to combine with the second liquid stream before flowing to the bottom of the absorber in the ethane recovery configuration; and wherein the absorber bottom product is configured to flow to the mid-section of the fractionator in the propane recovery configuration and to a top tray of the fractionator in the ethane recovery configuration.

4. The NGL plant of claim 3, wherein the fractionator overhead product is further configured to flow to a second separator after flowing to the chiller in the propane recovery configuration, wherein the second separator is configured to separate the fractionator overhead into the vapor portion and a liquid portion in the propane recovery configuration.

5. The NGL plant of claim 4, wherein the fractionator is configured to receive a first portion of the liquid portion of the fractionator overhead product at the top tray of the fractionator in the propane recovery configuration, wherein the absorber is configured to receive a second portion of the liquid portion of the fractionator overhead product in the propane recovery configuration.

6. The NGL plant of claim 3, wherein the absorber overhead product is heated in the first heat exchanger before being split into a first portion of the absorber overhead product and a second portion of the absorber overhead product in the ethane recovery configuration, wherein the second portion of the absorber overhead product comprises a sales gas in the ethane recovery configuration.

* * * * *